US011807927B2

(12) United States Patent
Park et al.

(10) Patent No.: US 11,807,927 B2
(45) Date of Patent: Nov. 7, 2023

(54) COMPLEX COPPER ALLOY INCLUDING HIGH-ENTROPY ALLOY AND METHOD OF MANUFACTURING SAME

(71) Applicant: WONJINMETAL Co., Ltd., Dongducheon-si (KR)

(72) Inventors: Eunsoo Park, Seoul (KR); Kooknoh Yoon, Seoul (KR); Jiyoung Kim, Seoul (KR); Jeongwon Yeh, Seoul (KR)

(73) Assignee: WONJINMETAL CO., LTD., Dongducheon-si (KR)

( * ) Notice: Subject to any disclaimer, the term of this patent is extended or adjusted under 35 U.S.C. 154(b) by 59 days.

(21) Appl. No.: 17/286,942

(22) PCT Filed: Oct. 22, 2019

(86) PCT No.: PCT/KR2019/013869
§ 371 (c)(1),
(2) Date: Apr. 20, 2021

(87) PCT Pub. No.: WO2020/085755
PCT Pub. Date: Apr. 30, 2020

(65) Prior Publication Data

US 2021/0395863 A1 Dec. 23, 2021

(30) Foreign Application Priority Data

Oct. 22, 2018 (KR) ..... 10-2018-0126132

(51) Int. Cl.
*C22C 9/04* (2006.01)
*C22C 1/03* (2006.01)

(52) U.S. Cl.
CPC . *C22C 9/04* (2013.01); *C22C 1/03* (2013.01)

(58) Field of Classification Search
CPC ..... C22C 9/04
See application file for complete search history.

(56) References Cited

U.S. PATENT DOCUMENTS

2002/0159914 A1 10/2002 Yeh
2008/0031766 A1 2/2008 Yeh
(Continued)

FOREIGN PATENT DOCUMENTS

CN 104911379 A 9/2015
CN 108220642 A 6/2018
(Continued)

OTHER PUBLICATIONS

Machine translation of CN104911379A (document published on Sep. 16, 2015) (Year: 2015).*
(Continued)

*Primary Examiner* — Christopher S Kessler
(74) *Attorney, Agent, or Firm* — Westman, Champlin & Koehler, P.A.; Amanda M. Prose

(57) ABSTRACT

Provided is a complex copper alloy including a high-entropy alloy and a method of manufacturing the same. The complex copper alloy includes a metal matrix including copper or a copper alloy and a high-entropy alloy (HEA) existing in a crystal grain of the metal matrix. A method of manufacturing the complex copper alloy is a method of manufacturing a complex copper alloy, which includes a metal matrix including copper or a copper alloy, and a high-entropy alloy (HEA) existing in a crystal grain of the metal matrix. The method includes preparing a raw material of the metal matrix and raw material of the high-entropy alloy and melting and alloying the raw material of the metal matrix and the raw material of the high-entropy alloy.

8 Claims, 4 Drawing Sheets

(56) References Cited

U.S. PATENT DOCUMENTS

| | | | | |
|---|---|---|---|---|
| 2013/0108502 | A1 | 5/2013 | Bei | |
| 2017/0218480 | A1* | 8/2017 | Park | C23F 1/00 |

FOREIGN PATENT DOCUMENTS

| | | | |
|---|---|---|---|
| KR | 10-1744102 | B1 | 6/2017 |
| KR | 10-2017-0124441 | A | 11/2017 |
| KR | 10-2020-0045432 | A | 5/2020 |

OTHER PUBLICATIONS

International Search Report and Written Opinion issued for PCT/KR2019/013869, dated Feb. 7, 2020, with English Translation.

Chen, J. "Fabrication and mechanical properties of AICoNiCrFe high-entropy alloy particle reinforced CU matrix composites" Journal of Alloys and Compounds, vol. 649 (2015) pp. 630-634.

Carcea, I. "Investigations on composites reinforced with HEA particles" IOP Conf. Series: Materials Science and Engineering, vol. 227 (2017) 012021.

Office Action issued for KR 10-2019-0131356 dated Mar. 15, 2021, with English Machine Translation.

Mohanty, S. et al. "Sinter ageing of equiatomic AI20Co20Cu20Zn20Ni20 high entropy alloy via mechanical alloying" Materials Science and Engineering: A, vol. 617, Nov. 3, 2014, pp. 211-218.

Zhang, Y. et al. "Particle size distribution and composition in phase-separated Cu75Co25 alloys under various magnetic fields" Scripta Materialia, vol. 82, Jul. 1, 2014, pp. 5-8.

Extended European Search Report issued for EP patent applciation serial No. 19876627.1, dated Jul. 11, 2022.

* cited by examiner

COMPLEX COPPER ALLOY INCLUDING HIGH-ENTROPY ALLOY AND METHOD OF MANUFACTURING SAME

CROSS-REFERENCE TO RELATED APPLICATION

This Application is a Section 371 National Stage Application of International Application No. PCT/KR2019/013869, filed Oct. 22, 2019 and published as WO2020/085755 on Apr. 30, 2020, in Korean, which claims priority to KR Patent Application Serial No. 10-2018-012632, filed Oct. 22, 2018 the contents of which are hereby incorporated by reference in their entirety.

BACKGROUND OF THE INVENTION

1. Field of the Invention

The present invention relates to a complex copper alloy, including a high-entropy alloy and a method of manufacturing the same.

2. Description of the Related Art

Brass is an alloy manufactured by adding zinc (Zn) to copper (Cu), and has a golden color and thus is aesthetically pleasing. Brass is capable of precisely realizing fine shapes due to the excellent malleability and machinability thereof, and thus has come to be widely used in the faucet business and for gas piping. In particular, in order to use brass for various purposes as described above, the machinability thereof is very important. However, in the case of brass products, since the ductility thereof is very high, chips are easily formed between cutting processes, causing a problem of sharply reduced machinability.

In the related art, to solve the problem, a lead precipitate is formed in a matrix (brass) by alloying brass and lead (Pb), thereby improving machinability. Lead has a high positive (+) heat of mixing and also a large difference in melting point from copper. For this reason, Cu (brass) and lead alloy have a monotectic reaction which is represented by the liquid-phase separation at high temperature. Since lead is separated from the Cu-rich liquid phase during solidification, it is known that most of the lead precipitate is formed inside the grains rather than at grain boundaries. Moreover, since lead has a very high interfacial energy in the liquid phase thereof, the precipitate formed is grown to have a spherical shape. In general, when a film-type precipitate is formed along the grain boundaries since a rapid fracture phenomenon occurs along the grain boundaries, the lead precipitate is known to act as a lubricant during a cutting process, so the availability thereof is great.

However, recently, the demand for lead-free brass (Pb-free brass) not containing lead has rapidly increased due to environmental regulations in the international community, including the United States and the European Union. Moreover, the research and development on alternative materials have been actively conducted. Meanwhile, bismuth (Bi) exhibits similar thermodynamic behavior with lead in copper. Therefore, lead-free brass containing bismuth has been attracted so much interest, nowadays. However, there is a problem in that, unlike lead, due to the low interfacial energy of bismuth, a significant amount of film-type precipitate is formed along the grain boundaries of the brass, thereby easily leading to fractures during a cutting process.

SUMMARY OF THE INVENTION

Accordingly, the present invention has been made keeping in mind the problems occurring in the related art, and the present invention provides a complex copper alloy with excellent mechanical properties.

The present invention provides a method of manufacturing the complex copper alloy.

Other objects of the present invention will become apparent from the following detailed description and accompanying drawings.

According to Examples of the present invention, a complex copper alloy includes a metal matrix, including copper or a copper alloy, and a high-entropy alloy (HEA) $2^{nd}$ phase existing inside the grains of the matrix.

The metal matrix may be composed of the first phase, and the high-entropy alloy may be composed of a second phase-separated from the first phase.

The high-entropy alloy may have a spherical shape. The high-entropy alloy may have a size of 10 μm or less. The high-entropy alloy may include one or more alloy elements selected from the group consisting of Cr, Mn, Fe, Co, and Ni. The high-entropy alloy may further include one or more alloy elements selected from the group consisting of Al, Ta, Nb, V, Mo, and W.

The complex copper alloy may have the following Chemical Formula 1.

$$(Cu_{100-x}Zn_x)_y(HEA)_{100-y} \quad \text{[Chemical Formula 1]}$$

(in Chemical Formula 1, $0 \le x \le 45$, $90 < y \le 100$ at %, and HEA is constituted with one or more alloy elements selected from the group consisting of Cr, Mn, Fe, Co, and Ni)

The copper alloy may include one or more alloy elements selected from the group consisting of Pb, Sn, Sb, As, Bi, Cd, P, Mg, and Si.

The high-entropy alloy may be homogeneously distributed inside the grains of the matrix.

The metal matrix may be composed of pure or copper alloy (brass).

A method of manufacturing a complex copper alloy, which includes a metal matrix including copper or a copper alloy, and high-entropy alloy (HEA) precipitations existing inside grains of the metal matrix, according to Examples of the present invention includes preparing a raw material of the metal matrix and raw material of the high-entropy alloy, and melting and alloying the raw material of the metal matrix and the raw material of the high-entropy alloy.

The metal matrix may be composed of the first phase, and the high-entropy alloy may be composed of a second phase-separated from the first phase.

The solidification rate when alloying the molten raw material may be controlled to form a precipitate of the high-entropy alloy. The shape and size of the high-entropy alloy may be controlled by changing the cooling rate of $10^{-3}$ K/s or more and $10^{3}$ K/s or less.

The high-entropy alloy may have a spherical shape having a size of 10 μm or less. The high-entropy alloy may include one or more alloy elements selected from the group consisting of Cr, Mn, Fe, Co, and Ni. The high-entropy alloy may further include one or more alloy elements selected from the group consisting of Al, Ta, Nb, V, Mo, and W.

The complex copper alloy may have the following Chemical Formula 1.

$$(Cu_{100-x}Zn_x)_y(HEA)_{100-y} \quad \text{[Chemical Formula 1]}$$

(In Chemical Formula 1, $0 \le x \le 45$, $90 < y \le 100$ at %, and HEA is constituted with one or more alloy elements selected from the group consisting of Cr, Mn, Fe, Co, and Ni.)

The copper alloy may include one or more alloy elements selected from the group consisting of Pb, Sn, Sb, As, Bi, Cd, P, Mg, and Si.

The high-entropy alloy precipitations may be homogeneously distributed in the grains of the metal matrix.

The complex copper alloy according to Examples of the present invention has excellent physical properties. For example, the complex copper alloy has excellent machinability, formability, and mechanical properties. Further, the complex copper alloy is environmentally friendly. The complex copper alloy is used to manufacture various processed products such as faucet products and pipes.

BRIEF DESCRIPTION OF THE DRAWINGS

The above and other objects, features, and advantages of the present invention will be more clearly understood from the following detailed description taken in conjunction with the accompanying drawings, in which.

DESCRIPTION OF THE PREFERRED EMBODIMENTS

Figure 1:
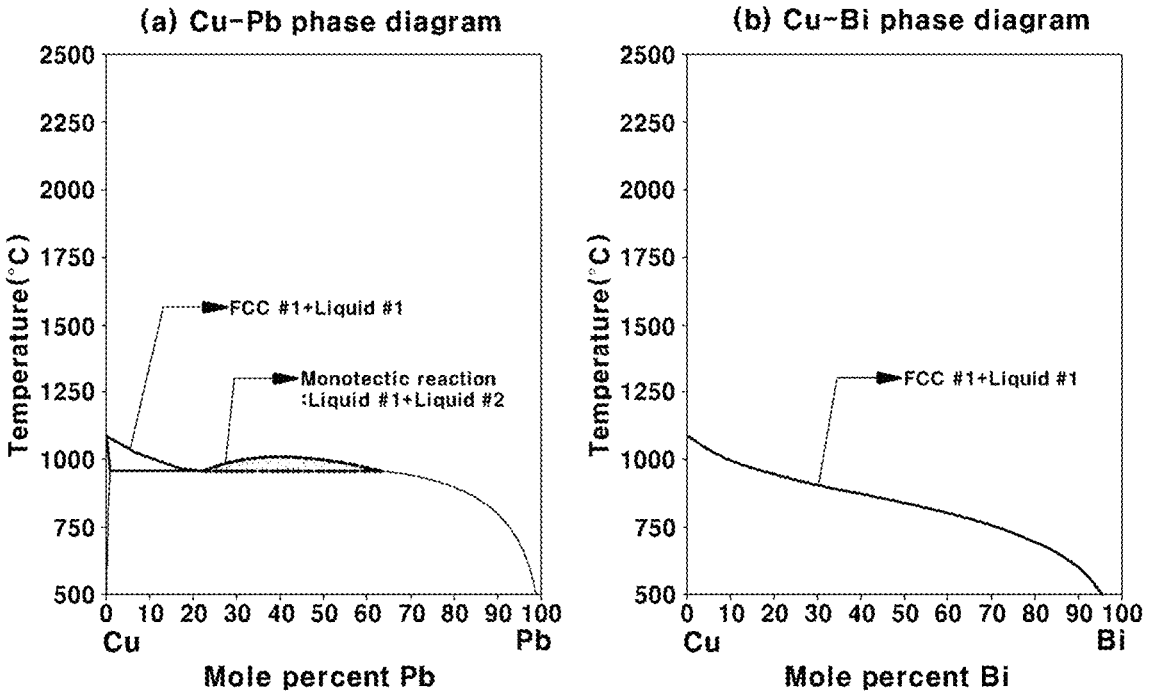
FIG. 1 shows thermodynamically calculated binary phase diagrams (a) between copper (Cu) and lead (Pb) and (b) between copper (Cu) and bismuth (Bi)

Hereinafter, the present invention will be described in detail through Examples. The objects, features, and advantages of the present invention will be readily understood through the following Examples. The present invention is not limited to the Examples described herein, but may be embodied in other forms. The Examples introduced here are provided to ensure that the disclosed contents are thorough and complete and that the spirit of the present invention is sufficiently transferred to a person having ordinary knowledge in the technical field to which the present invention pertains. Therefore, the present invention should not be limited by the following Examples.

When an element "includes" any other element in the specification, this means that unless otherwise indicated, other elements may be further included rather than excluded.

A complex copper alloy according to Examples of the present invention includes a metal matrix, including copper or a copper alloy, and a high-entropy alloy (HEA) existing in grains of the metal matrix.

The metal matrix may be composed of the first phase, and the high-entropy alloy may be composed of a second phase that is separated from the first phase.

The high-entropy alloy may have a spherical shape. The high-entropy alloy may have a size of 10 μm or less. The high-entropy alloy may include one or more alloy elements selected from the group consisting of Cr, Mn, Fe, Co, and Ni. The high-entropy alloy may further include one or more alloy elements selected from the group consisting of Al, Ta, Nb, V, Mo, and W.

The complex copper alloy may have the following Chemical Formula 1.

$$(Cu_{100-x}Zn_x)_y(HEA)_{100-y} \quad \text{[Chemical Formula 1]}$$

(in Chemical Formula 1, $0 \le x \le 45$, $90 < y \le 100$ at %, and HEA is constituted with one or more alloy elements selected from the group consisting of Cr, Mn, Fe, Co, and Ni)

The copper alloy may include one or more alloy elements selected from the group consisting of Pb, Sn, Sb, As, Bi, Cd, P, Mg, and Si.

The high-entropy alloy precipitations may be homogeneously distributed in the grains of the metal matrix.

The alloy may have a copper or a copper alloy (brass) matrix.

A method of manufacturing a complex copper alloy, which includes a metal matrix including copper or copper alloy, and high-entropy alloy (HEA) precipitations existing in a crystal grain of the metal matrix, according to Examples of the present invention includes preparing a raw material of the metal matrix and raw material of the high-entropy alloy and melting and alloying the raw material of the metal matrix and the raw material of the high-entropy alloy.

The metal matrix may have the first phase, and the high-entropy alloy may precipitate as a second phase that is separated from the first phase.

The solidification when alloying the molten raw material may be controlled to form a precipitate of the high-entropy alloy. The shape and size of the high-entropy alloy may be controlled by changing a cooling rate of $10^{-3}$ K/s or more and $10^3$ K/s or less.

The high-entropy alloy precipitation may have a spherical shape having a size of 10 μm or less. The high-entropy alloy may include one or more alloy elements selected from the group consisting of Cr, Mn, Fe, Co, and Ni. The high-entropy alloy may further include one or more alloy elements selected from the group consisting of Al, Ta, Nb, V, Mo, and W.

The complex copper alloy may have the following Chemical Formula 1.

$$(Cu_{100-x}Zn_x)_y(HEA)_{100-y} \quad \text{[Chemical Formula 1]}$$

(In Chemical Formula 1, $0 \le x \le 45$, $90 < y \le 100$ at %, and HEA includes one or more alloy elements selected from the group consisting of Cr, Mn, Fe, Co, and Ni.)

The copper alloy may include one or more alloy elements selected from the group consisting of Pb, Sn, Sb, As, Bi, Cd, P, Mg, and Si.

The high-entropy alloy precipitations may be homogeneously distributed in the grains of the metal matrix.

In the preparation of the raw materials, it is preferable to prepare an alloying element that has the relationship of positive (+) heat of mixing with respect to copper, acting as the main element of the first phase, to thus influence the properties of the metal matrix and which easily constitutes a single phase of a high-entropy alloy having a face-centered cubic (FCC) structure. Thereby, the precipitate of the high-entropy alloy, having high phase stability, is separated from the metal matrix even in a liquid phase. So spherical precipitations may be easily formed in the crystal grains of the metal matrix.

In the melting and alloying of the raw materials, it is important to homogeneously melt the alloying elements. The melting and alloying may be performed using a commercial heating method including an arc-melting method, an induction-heating method, and a resistance-heating method. It is preferable to perform the melting at a sufficiently high temperature so that individual phases are separated from the liquid phase due to a monotectic reaction caused by the positive (+) heat of mixing, thereby making it easy to form a spherical shape. When a molten metal alloy is solidified to manufacture a complex copper alloy, the solidification rate may be controlled to control the shape of the composite phase (the distribution of the high-entropy alloy and the size of the precipitate). Further, the complex copper alloy may be formed into a suitable microstructure through a post-treatment process including rolling and a heat-treatment process.

FIG. 1 shows thermodynamically calculated binary phase diagrams (a) between copper (Cu) and lead (Pb) and (b) between copper (Cu) and bismuth (Bi).

Referring to FIG. 1, unlike lead, bismuth (Bi), which has a smaller positive heat of mixing than copper, does not cause a monotectic reaction that causes phase separation in a high-temperature liquid phase. Accordingly, after the matrix phase of the brass alloy is solidified, the second phase may be precipitated, thus limiting precipitation in the grain. In particular, unlike lead, since bismuth has low interfacial energy with liquid-phase brass, bismuth is not easily precipitated into spherical precipitates, but is precipitated so as to have a film shape along the grain boundary after the solidification of brass is finished. This may lead to rapid fractures along the precipitate formed during a cutting process so that bismuth may have relatively lower machinability than leaded brass. Table 1 shows Comparative Examples including pure copper (Comparative Example 1), a brass alloy (Comparative Examples 2 to 4) obtained by alloying copper and zinc, and a brass alloy composition including lead (Comparative Example 5) or bismuth (Comparative Example 6).

TABLE 1

| Classification | Composition | Crystal structure | Shape of precipitate |
|---|---|---|---|
| Comparative Example 1 | Cu | FCC | No precipitation |
| Comparative Example 2 | $Cu_{80}Zn_{20}$ | FCC | No precipitation |
| Comparative Example 3 | $Cu_{70}Zn_{30}$ | FCC | No precipitation |
| Comparative Example 4 | $Cu_{60}Zn_{40}$ | FCC + BCC | No precipitation |
| Comparative Example 5 | $(Cu_{70}Zn_{30})_{98}Pb_2$ | FCC1 + FCC2 | Spherical shape/ precipitation in grains |
| Comparative Example 6 | $(Cu_{70}Zn_{30})_{98}Bi_2$ | FCC1 + FCC2 | Film/precipitation at grain boundaries |

In order to ensure excellent machinability, it is necessary to limit precipitation at the grain boundary of the precipitate not containing lead as the main element so that the precipitate having a spherical shape is homogeneously distributed in the grain.

The complex copper alloys according to the Examples of the present invention include novel alloyed elements. In the case of the alloy included in the complex copper alloys, to ensure excellent properties, the alloy needs to have a large positive (+) heat of mixing with respect to a brass matrix, particularly copper determining properties of brass, and a deterioration in properties of the brass must not occur in the alloying with the brass matrix. In consideration thereof, element groups for use in alloying were selected, as shown in Table 2 below.

TABLE 2

| Element group I | | Element group II | |
|---|---|---|---|
| Classification | Heat of mixing | Classification | Heat of mixing |
| Ni | +4 | Al | +1 |
| Mn | +4 | Ta | +2 |
| Co | +6 | Nb | +3 |
| Cr | +12 | V | +5 |
| Fe | +13 | Mo | +19 |
| | | W | +22 |

The element group I shown in Table 2 includes Ni, Mn, Co, Cr, and Fe, which are five kinds of elements forming a single phase of a high-entropy alloy having an FCC crystal structure among alloys having a large positive heat of mixing with respect to copper. The high-entropy alloy is an alloy system in which various kinds of elements act as main elements, has high phase stability even at high temperatures, and may easily cause a liquid-phase separation with a copper matrix.

The element group II includes elements that do not form the FCC high-entropy alloy, has a positive heat of mixing with respect to copper to be separated from brass, and is alloyed with the FCC high-entropy alloy, thus improving mechanical properties such as the strength of a precipitation phase. The following Table 3 shows various Comparative Examples of the present invention, including an alloy including a combination of the element group I to easily form the FCC crystal structure (Comparative Examples 7 to 11) and an alloy system in which a small amount of element group II is added to the corresponding alloy (Comparative Examples 12 and 13).

TABLE 3

| Classification | Composition | Crystal structure | Shape of precipitate |
|---|---|---|---|
| Comparative Example 7 | Ni | FCC | No precipitation |
| Comparative Example 8 | CoNi | FCC | No precipitation |
| Comparative Example 9 | FeCoNi | FCC | No precipitation |
| Comparative Example 10 | CrFeCoNi | FCC | No precipitation |
| Comparative Example 11 | CrMnFeCoNi | FCC | No precipitation |
| Comparative Example 12 | $Al_{0.3}CrFeCoNi$ | FCC | No precipitation |
| Comparative Example 13 | $V_{0.3}CrFeCoNi$ | FCC | No precipitation |

Figure 2:
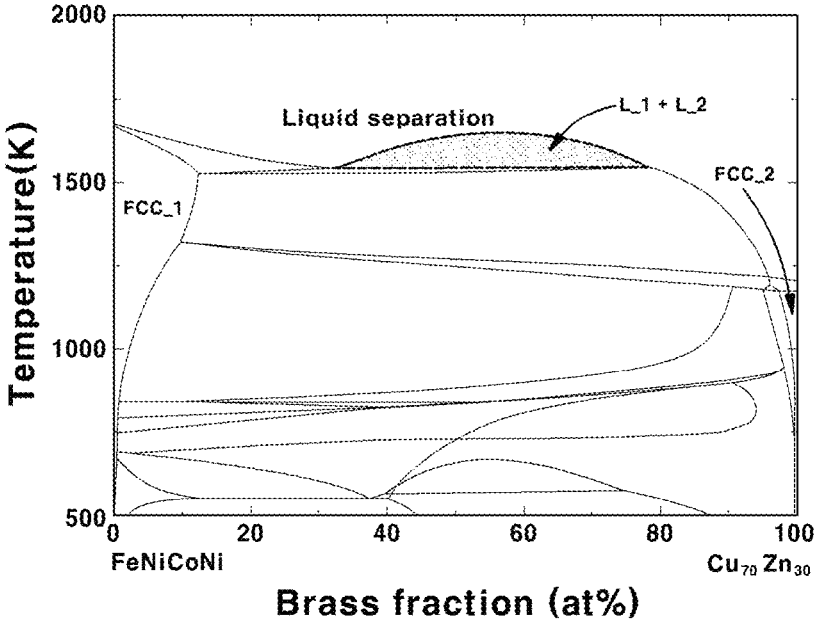
FIG. 2 shows the thermodynamically calculated result of the pseudo-binary phase diagram between a brass ($Cu_{70}Zn_{30}$) of a representative composition of Comparative Example 3 and a CrFeCoNi alloy of Comparative Example 10.

FIG. 2 shows a pseudo-binary phase diagram, calculated using a thermo-calc software (based on TC-HEA 3 database), between Comparative Example 3 of $Cu_{70}Zn_{30}$, which is a brass alloy of a representative composition, and Comparative Example 10 of a quaternary high-entropy alloy having a composition of CrFeCoNi. This shows the tendency of a phase separation phenomenon.

It can be confirmed that the high-entropy alloy phase having high phase stability even at high temperatures exhibits a phase separation phenomenon even in a liquid phase, as in a conventional lead-copper phase diagram. Further, in general, an alloy including transition metals exhibits greater interfacial energy than lead (copper: 1360 dynes/$cm^2$, nickel: 1770 dynes/$cm^2$, and lead: 442 dynes/$cm^2$—based on a substrate having low surface energy). Accordingly, the precipitation phase including the transition metal may have a spherical shape that is easily maintained during a solidification process and may be homogeneously distributed in the form of a precipitate in the crystal grain.

The brass is an alloy of copper and zinc, and the atomic radius of the two alloy elements are very similar to each other; specifically, copper has a radius of 145 μm and zinc has a radius of 142 μm. Accordingly, the brass may form a substituted solid solution in a wide composition range. In particular, brass generally contains a larger amount of copper than zinc, so the brass may exhibit thermodynamic properties similar to the thermodynamic properties of copper, which acts as a matrix. Therefore, when copper and brass are used as the matrix, the thermodynamic behaviors of the alloys constituting the pseudo-binary system between alloyed phase-separable elements are considered to be similar to each other.

Figure 3:
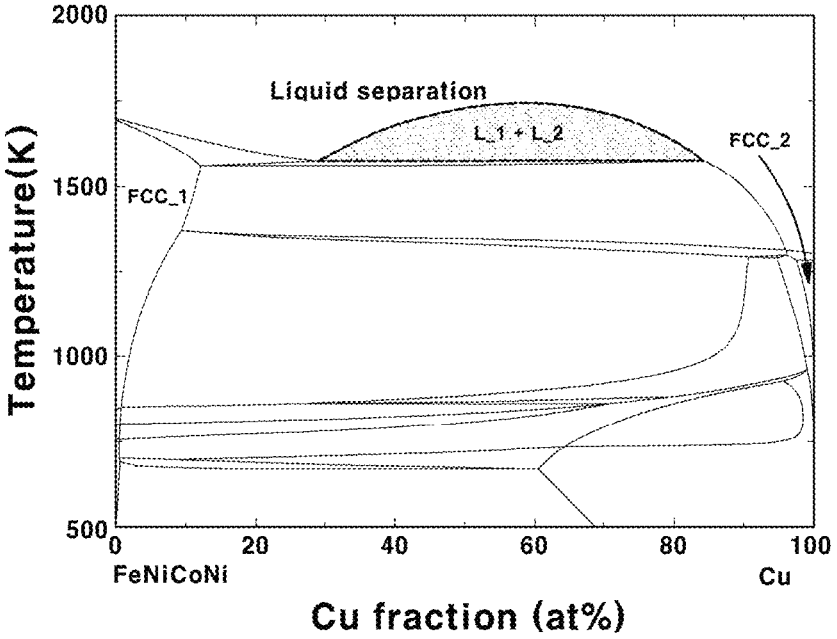
FIG. 3 shows the thermodynamically calculated result of the pseudo-binary phase diagram between pure copper (Cu) of Comparative Example 1 and a CrFeCoNi alloy of Comparative Example 10.

In order to prove this, a thermodynamic simulation was performed. The result of calculation in FIG. 3 shows a pseudo-binary phase diagram (based on a TC-HEA 3 database) between the quaternary high-entropy alloy of CrFeCoNi, which is Comparative Example 10, and pure copper, which is Comparative Example 1. The height (temperature) of the liquid-phase separation region of the two-phase diagrams is lower than that of the case of brass containing zinc, but this is a general tendency according to the alloying of zinc having a low melting point (419° C.). Accordingly, the phase diagram of FIG. 3 and the phase diagram between the brass and the high-entropy alloy of FIG. 2 exhibit similar shapes. That is, it can be confirmed that brass and pure copper exhibit similar solidification behaviors upon alloying with elements constituting the high-entropy alloy. Therefore, based on the fact that the solidification behaviors of copper and brass are similar to each other in the alloying with elements constituting the high-entropy alloy, the properties of related alloys will be described below based on the relationship between copper and the high-entropy alloy.

The complex copper alloys according to the Examples of the present invention were manufactured and the properties thereof were analyzed. The complex copper alloys were melted using induction casting method, which has a stirring effect by an electromagnetic field making it easy to manufacture a homogeneous microstructure, and then rapidly cooled. In addition to the induction casting method, it is possible to manufacture the complex copper alloys through a commercial casting process using an arc-melting method in which a bulk homogeneous solid solution is rapidly manufactured and impurities such as oxides and pores are minimized because high temperatures are capable of being achieved using arc plasma, a resistance-heating method in which a temperature is capable of being precisely controlled, and a rapid-cooling solidification method that is useful for the formation of a homogeneous solid solution. Further, the complex copper alloys may be manufactured using the commercial casting method, in which high-melting-point metals of raw metals are capable of being melted and may be manufactured by sintering raw materials manufactured in a powder form according to spark plasma sintering or hot isostatic pressing sintering using a powder metallurgy method at high temperatures under high pressure. In the case of the sintering method, it is easy to more precisely control a microstructure and to manufacture parts having desired shapes. The alloy that is manufactured may be cold rolled, hot rolled, or heat-treated for recrystallization.

The alloy compositions of the complex copper alloys according to the Examples of the present invention may be represented by Chemical Formula 1 below, and the high-entropy alloy (HEA) represents the composition of the precipitate alloy constituting the second phase.

$$(Cu_{100-x}Zn_x)_y(HEA)_{100-y} \quad \text{[Chemical Formula 1]}$$

($0 \le x \le 45$, $90 < y \le 100$ at %, and the high-entropy alloy includes one or more alloy elements selected from the group consisting of Cr, Mn, Fe, Co, and Ni.)

Figure 4:
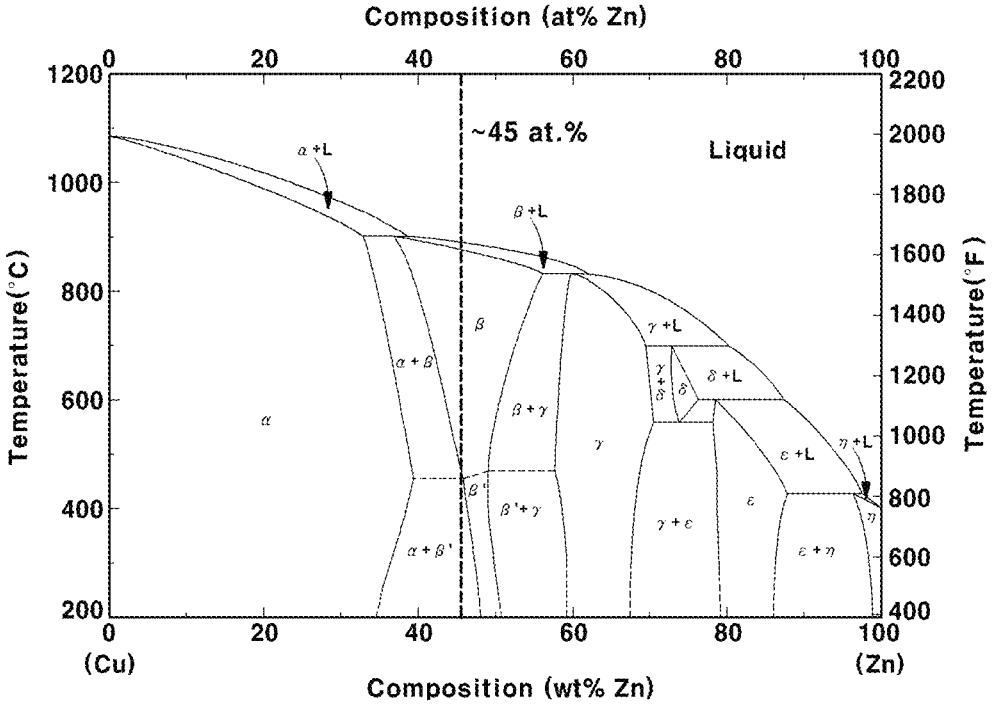
FIG. 4 shows a binary phase diagram exhibiting the relationship between copper (Cu) and zinc (Zn) constituting brass.

The metal matrix of the complex copper alloy according to the Example of the present invention may include copper and zinc, and the amount of zinc may be up to 45 at % based on the entire metal matrix. This is because the brass alloy commonly used includes an FCC single-phase or a composite structural alloy having an FCC phase including a BCC phase. As shown in FIG. 4, when a Cu—Zn binary alloy contains Zn in an amount of more than 45 at %, an α phase having an FCC crystal structure is not formed, and other alloys such as a single alloy of a β phase having a BCC crystal structure are formed. Accordingly, it is not preferable that Zn be contained in an amount of more than 45 at % based on the matrix alloy of the first phase. That is since an alloy having an α phase or a composite structure of α and β phases are classified as a brass alloy, it is preferable to exclude the alloy region which contains Zn in an amount of more than 45 at % and in which the α phase is no longer formed.

Further, the high-entropy alloy (HEA) of Chemical Formula 1 includes an alloy of one or more elements selected from the element group I consisting of Cr, Mn, Fe, Co, and Ni, among the elements constituting the FCC high-entropy alloy. The following Table 4 shows Examples of various kinds of alloys satisfying Chemical Formula 1.

TABLE 4

| Classification | Composition | Crystal structure | Shape and distribution of precipitate |
|---|---|---|---|
| Example 1 | $Cu_{90}Fe_{10}$ | FCC1 + FCC2 | Spherical shape/ in grain |
| Example 2 | $Cu_{90}(CrFe)_{10}$ | FCC1 + FCC2 | Spherical shape/ in grain |
| Example 3 | $Cu_{98}(FeCoNi)_2$ | FCC1 + FCC2 | Spherical shape/ in grain |
| Example 4 | $Cu_{98}(CrFeCo)_2$ | FCC1 + FCC2 | Spherical shape/ in grain |
| Example 5 | $Cu_{98}(CrFeNi)_2$ | FCC1 + FCC2 | Spherical shape/ in grain |
| Example 6 | $Cu_{98}(CrCoNi)_2$ | FCC1 + FCC2 | Spherical shape/ in grain |
| Example 7 | $Cu_{95}(FeCoNi)_5$ | FCC1 + FCC2 | Spherical shape/ in grain |
| Example 8 | $Cu_{95}(CrFeCo)_5$ | FCC1 + FCC2 | Spherical shape/ in grain |

TABLE 4-continued

| Classification | Composition | Crystal structure | Shape and distribution of precipitate |
|---|---|---|---|
| Example 9 | $Cu_{95}(CrFeNi)_5$ | FCC1 + FCC2 | Spherical shape/ in grain |
| Example 10 | $Cu_{95}(CrCoNi)_5$ | FCC1 + FCC2 | Spherical shape/ in grain |
| Example 11 | $Cu_{98}(CrFeCoNi)_2$ | FCC1 + FCC2 | Spherical shape/ in grain |
| Example 12 | $Cu_{95}(CrFeCoNi)_5$ | FCC1 + FCC2 | Spherical shape/ in grain |
| Example 13 | $Cu_{98}(CrFeCoNiMn)_2$ | FCC1 + FCC2 | Spherical shape/ in grain |
| Example 14 | $Cu_{95}(CrFeCoNiMn)_5$ | FCC1 + FCC2 | Spherical shape/ in grain |

From the result of alloying pure copper and one to five elements selected from alloy elements included in the element group I, as shown in Table 4, it could be confirmed that spherical precipitations were formed in the grains of the related alloy.

Figure 5:
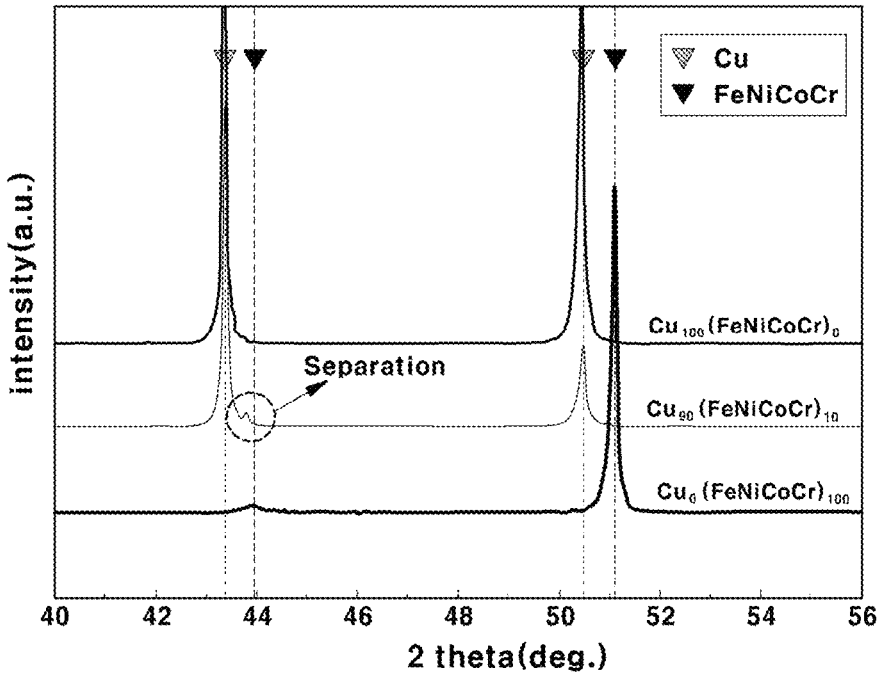
FIG. 5 shows the results of X-ray diffraction (XRD) analysis of pure copper (Cu) of Comparative Example 1, a CrFeCoNi alloy of Comparative Example 10, and a $Cu_{90}(CrFeCoNi)_{10}$ alloy of Example 15 of the present invention.

FIG. 5 shows the results of X-ray diffraction (XRD) analysis of Comparative Examples 1 and 10 and Example 12. As shown in the figures, it can be confirmed that the precipitate of the high-entropy alloy is separated from the copper matrix of the first phase in the alloy of Example 12.

Figure 6:
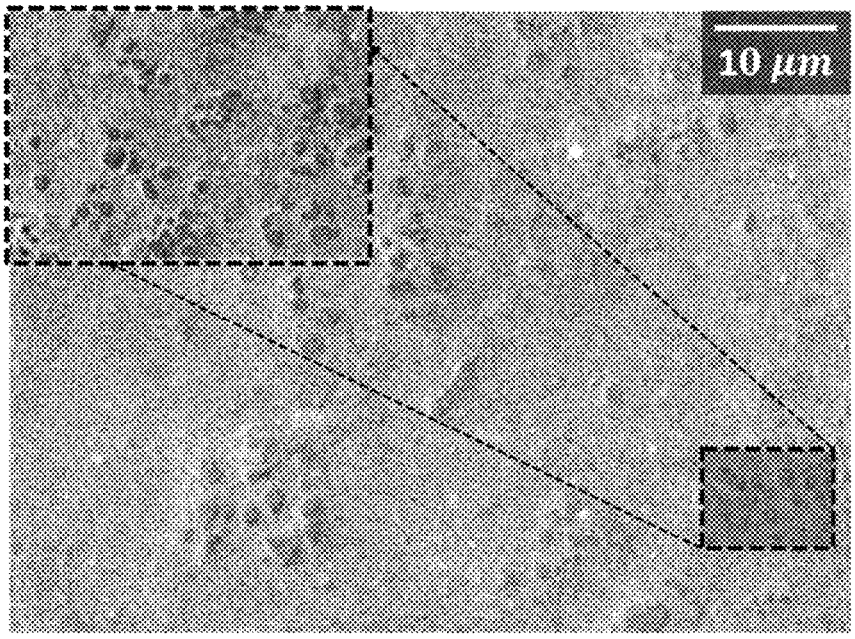
FIG. 6 shows a scanning electron microscope (SEM) image exhibiting the microstructure of a $Cu_{95}(CrFeCoNi)_5$ alloy of Example 12 of the present invention.

In particular, the above result can be confirmed from the results of optical microscope analysis shown in FIG. 6. FIG. 6 shows the microstructure of Example 12, and it can be confirmed that the spherical precipitate is formed well in the grains over the entire region of the material.

Figure 7:
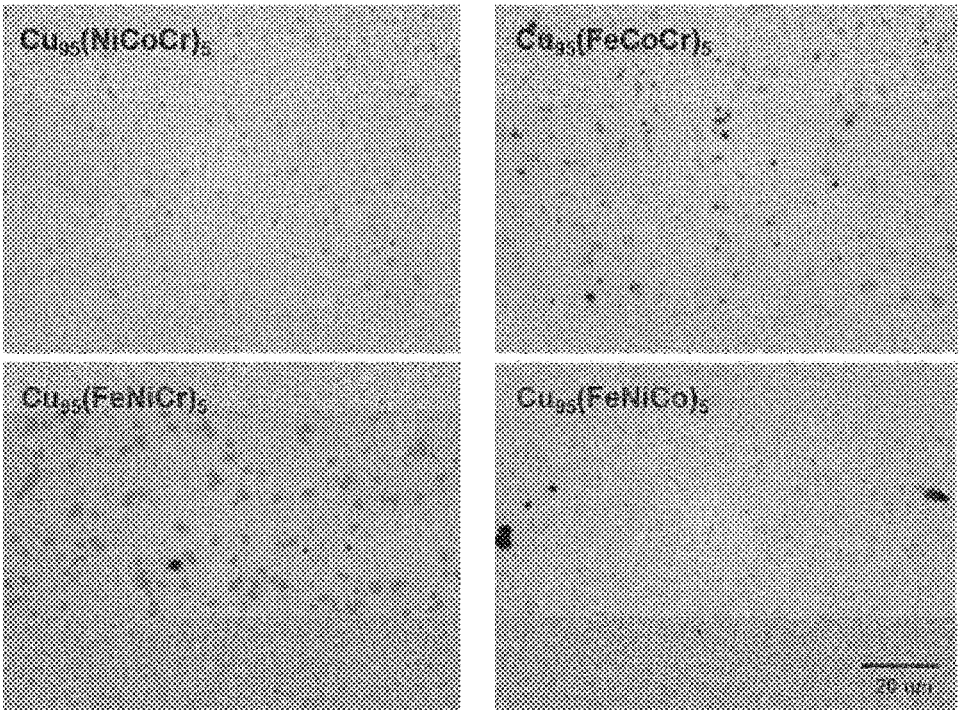
FIG. 7 shows optical microscope (OP) images exhibiting the microstructures of $Cu_{95}(CrCoNi)_5$, $Cu_{95}(CrFeCo)_5$, $Cu_{95}(CrFeNi)_5$, and $Cu_{95}(FeCoNi)_5$ alloys respectively corresponding to Examples 7 to 10.

It can be confirmed that this phenomenon is a property that may be expressed in all of the various alloys of the present invention precipitated based on the above-described mechanism as well as in the alloy of Example 12 (Table 4), and these results are shown in detail in FIG. 7. FIG. 7 shows microstructures for the compositions of Examples 7 to 10, and corresponds to the case of selecting three elements among the elements constituting the FCC high-entropy alloy and then alloying the selected elements with copper. It can be easily confirmed that the spherical precipitates are homogeneously formed in the grains over the entire region of the alloy of the copper matrix.

Therefore, as shown in FIGS. 5 to 7, it can be confirmed that even when various kinds of alloy elements having a positive heat of mixing with respect to copper are operated simultaneously, a brass alloy matrix of a first phase and a high-entropy alloy precipitate of a second phase are formed without forming a new phase.

The form (shape and size) of the precipitate that is capable of being formed in the complex copper alloys according to the Examples of the present invention may be controlled by varying the process conditions. As shown in Table 5, it can be confirmed that when the composition alloy of the present invention as in Example 15 is solidified using furnace cooling (cooling speed: less than $10^{-3}$ K/s) (Comparative Example 14), a coarse second phase having a size of several tens of μm or more is formed so as to have a dendritic pattern, unlike a precipitate having a size of 10 μm or less formed using conventional water cooling (cooling speed: $10^{-3}$ K/s or more and $10^3$ K/s or less). That is, the control of process conditions may significantly affect the control of the shape and size of the precipitate.

Further, when a coarse precipitate having a size of more than 10 μm is precipitated in a spherical or dendritic shape, the total interface length between the matrix and the precipitate is reduced. Accordingly, during processing, a stress concentration phenomenon may occur, which may lead to rapid fractures. Therefore, it is preferable that the precipitate be formed so as to have a size of 10 μm or less.

TABLE 5

| Classification | Composition | Crystal structure | Shape and size of precipitate | Note |
|---|---|---|---|---|
| Example 15 | $Cu_{90}(CrFeCoNi)_{10}$ | FCC1 + FCC2 | Spherical shape (size 10 μm or less) | Rapid cooling (cooling speed: $10^{-3}$ K/s or more and $10^3$ K/s or less) |
| Comparative Example 14 | $Cu_{90}(CrFeCoNi)_{10}$ | FCC1 + FCC2 | Spherical shape/ dendritic pattern (size~several tens μm) | Furnace cooling (cooling speed: less than $10^{-3}$ K/s) |

As shown in Comparative Example 15 of Table 6, in the case of the alloy that contains the high-entropy alloy phase in an amount of more than 10 at %, a large amount of precipitate having a size of several tens of μm or more is obtained in the form of dendritic-pattern branches throughout the material even during rapid cooling, thereby decreasing the machinability, as in the case where the coarse precipitate is formed. Accordingly, it is preferable that the high-entropy alloy element forming the precipitate be used in an amount of 10 at % or less in order to perform the alloying. That is, the results based on Example 15 and Comparative Examples 14 and 15 above mean that the amount of the high-entropy alloy phase shown in Chemical Formula 1 must be 10 at % or less based on the entirety of each of the alloy compositions during the alloying. It is preferable that the cooling speed be controlled to be $10^{-3}$ K/s or more and $10^3$ K/s or less.

TABLE 6

| Classification | Composition | Crystal structure | Shape and size of precipitate |
|---|---|---|---|
| Comparative Example 15 | $Cu_{80}(CrMnFeCoNi)_{20}$ | FCC1 + FCC2 | Dendritic pattern branches (size~ several tens μm) |

Figure 8:
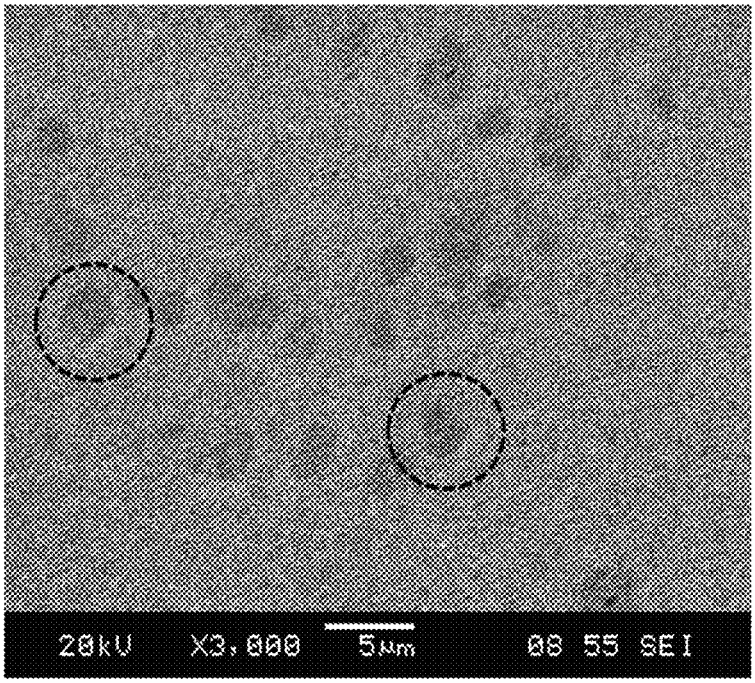
FIG. 8 shows a scanning electron microscope (SEM) image exhibiting the microstructure of a $(Cu_{70}Zn_{30})_{90}(CrFeCoNi)_{10}$ alloy of Example 19 of the present invention.

The following Table 7 shows that the phase separation phenomenon can be confirmed not only in the alloy of the pure copper matrix, but also in the brass matrix. When checking the microstructure of Example 19 shown in FIG. 8, it can be confirmed that the high-entropy alloy precipitate having a spherical shape according to the present invention is capable of being successfully formed even in the brass matrix.

TABLE 7

| Classification | Composition | Crystal structure | Shape and distribution of precipitate |
|---|---|---|---|
| Example 16 | $(Cu_{95}Zn_5)_{90}(CrFeCoNi)_{10}$ | FCC1 + FCC2 | Spherical shape/ in grain |
| Example 17 | $(Cu_{90}Zn_{10})_{90}(CrFeCoNi)_{10}$ | FCC1 + FCC2 | Spherical shape/ in grain |
| Example 18 | $(Cu_{80}Zn_{20})_{90}(CrFeCoNi)_{10}$ | FCC1 + FCC2 | Spherical shape/ in grain |
| Example 19 | $(Cu_{70}Zn_{30})_{90}(CrFeCoNi)_{10}$ | FCC1 + FCC2 | Spherical shape/ in grain |
| Example 20 | $(Cu_{60}Zn_{40})_{90}(CrFeCoNi)_{10}$ | FCC1 + FCC2 + BCC | Spherical shape/ in grain |

In order to improve the properties of the precipitate, the high-entropy alloy composition in Chemical Formula 1 may include one or more alloy elements selected from the element group II consisting of Al, Ta, Nb, V, Mo, and W, which are easily solid-solved in the high-entropy alloy phase without reducing the properties of the free cutting lead-free brass according to the Examples of the present invention, in an amount of up to 10 at % based on the high-entropy alloy. The composition is as shown in Examples 21 to 26 of the following Table 8.

TABLE 8

| Classification | Composition | Crystal structure | Shape and distribution of precipitate |
|---|---|---|---|
| Example 21 | $Cu_{90}(Al_{0.3}CrFeCoNi)_{10}$ | FCC1 + FCC2 | Spherical shape/in grain |
| Example 22 | $Cu_{90}(Ta_{0.3}CrFeCoNi)_{10}$ | FCC1 + FCC2 | Spherical shape/in grain |
| Example 23 | $Cu_{90}(Nb_{0.3}CrFeCoNi)_{10}$ | FCC1 + FCC2 | Spherical shape/in grain |
| Example 24 | $Cu_{90}(V_{0.3}CrFeCoNi)_{10}$ | FCC1 + FCC2 | Spherical shape/in grain |
| Example 25 | $Cu_{90}(Mo_{0.3}CrFeCoNi)_{10}$ | FCC1 + FCC2 | Spherical shape/in grain |
| Example 26 | $Cu_{90}(W_{0.3}CrFeCoNi)_{10}$ | FCC1 + FCC2 | Spherical shape/in grain |

Examples 27 to 35 shown in Table 9 below are for improving the machinability of the matrix, and one or more alloy elements selected from the alloy group consisting of Pb, Sn, Sb, As, Bi, Cd, P, Mg, and Si, which are known to improve machinability when added in small amounts to the material brass, may be used in alloying in respective amounts of 2 at % or less based on the total amount of the alloy elements.

TABLE 9

| Classification | Composition | Crystal structure | Shape of precipitate |
|---|---|---|---|
| Example 27 | $Cu_{88}Pb_2(CrFeCoNi)_{10}$ | FCC1 + FCC2 | Spherical shape |
| Example 28 | $Cu_{88}Sn_2(CrFeCoNi)_{10}$ | FCC1 + FCC2 | Spherical shape |
| Example 29 | $Cu_{88}Sb_2(CrFeCoNi)_{10}$ | FCC1 + FCC2 | Spherical shape |
| Example 30 | $Cu_{88}As_2(CrFeCoNi)_{10}$ | FCC1 + FCC2 | Spherical shape |
| Example 31 | $Cu_{88}Bi_2(CrFeCoNi)_{10}$ | FCC1 + FCC2 | Spherical shape |
| Example 32 | $Cu_{88}Cd_2(CrFeCoNi)_{10}$ | FCC1 + FCC2 | Spherical shape |

TABLE 9-continued

| Classification | Composition | Crystal structure | Shape of precipitate |
|---|---|---|---|
| Example 33 | $Cu_{88}P_2(CrFeCoNi)_{10}$ | FCC1 + FCC2 | Spherical shape |
| Example 34 | $Cu_{88}Mg_2(CrFeCoNi)_{10}$ | FCC1 + FCC2 | Spherical shape |
| Example 35 | $Cu_{88}Si_2(CrFeCoNi)_{10}$ | FCC1 + FCC2 | Spherical shape |

Hereinabove, specific Examples of the present invention have been described. A person having ordinary knowledge in the technical field to which the present invention pertains will understand that the present invention can be implemented in a modified form without departing from the essential characteristics of the present invention. Therefore, the disclosed Examples should be considered in terms of explanation rather than limitation. The present invention's scope is as set forth in the claims rather than in the previous description, and all variations within the equivalent range should be interpreted as being included in the present invention.

The complex copper alloy according to Examples of the present invention has excellent physical properties. For example, the complex copper alloy has excellent machinability (machinability), formability, and mechanical properties. Further, the complex copper alloy is environmentally friendly. The complex copper alloy is used to manufacture various processed products such as faucet products and pipes.

What is claimed is:

1. A complex copper alloy comprising:

Metal matrix including copper or a copper alloy; and

High-entropy alloy (HEA) precipitations existing inside grains of the metal matrix and wherein the high-entropy alloy has a spherical shape, wherein the complex copper alloy has a following Chemical Formula 1:

$$(Cu_{100-x}Zn_x)_y(HEA)_{100-y}, \quad \text{[Chemical Formula 1]}$$

(in Chemical Formula 1, $0 \le x \le 45$, $90 < y \le 100$ at %, and HEA includes one or more alloy elements selected from the group consisting of Cr, Mn, Fe, Co, and Ni).

2. The complex copper alloy of claim 1, wherein the copper alloy matrix has a first phase, and the high-entropy alloy precipitates as a second phase that is separated from the first phase.

3. The complex copper alloy of claim 1, wherein the high-entropy alloy has a size of 10 μm or less.

4. The complex copper alloy of claim 1, wherein the high-entropy alloy includes one or more alloy elements selected from the group consisting of Cr, Mn, Fe, Co, and Ni.

5. The complex copper alloy of claim 4, wherein the high-entropy alloy further includes one or more alloy elements selected from the group consisting of Al, Ta, Nb, V, Mo, and W.

6. The complex copper alloy of claim 1, wherein the copper alloy includes one or more alloy elements selected from the group consisting of Pb, Sn, Sb, As, Bi, Cd, P, Mg, and Si.

7. The complex copper alloy of claim 1, wherein the high-entropy alloy is homogeneously distributed in the grain of the metal matrix.

8. The complex copper alloy of claim 1, wherein the metal matrix includes a copper matrix or a brass matrix.

* * * * *